United States Patent [19]

Ailshie et al.

[11] 4,139,021

[45] Feb. 13, 1979

[54] HYDRAULIC CONTROL INSTRUMENTALITY

[75] Investors: Roger H. Ailshie, Lewis, Kans.; Kenneth G. McMillen, deceased, late of New Castle, Ind., by Leanne S. McMillen, administrator, Fort Wayne, Ind.

[73] Assignee: Cross Manufacturing, Inc., Lewis, Kans.

[21] Appl. No.: 273,330

[22] Filed: Jul. 19, 1972

[51] Int. Cl.[2] ..... F15B 13/08

[52] U.S. Cl. ..... 137/596.13; 91/420; 91/436; 91/446; 91/452

[58] Field of Search ..... 91/420, 436, 452, 444, 91/446, 448, 468; 137/596.12, 596.13, 625.69

[56] References Cited

U.S. PATENT DOCUMENTS

| | | | |
|---|---|---|---|
| 2,651,324 | 9/1953 | Hodgson et al. | 137/596.12 |
| 3,527,328 | 9/1970 | Maurice | 137/625.69 X |
| 3,613,711 | 10/1971 | Wilke | 91/420 X |
| 3,718,159 | 2/1973 | Tennis | 137/596.12 |

*Primary Examiner*—Gerald A. Michalsky
*Attorney, Agent, or Firm*—Edward L. Brown, Jr.

[57] ABSTRACT

Instrumentality for use in multiple spool control valve assemblies including a high pressure pilot operated relief valve that exhausts fluid from the chamber being protected through a pair of exhaust passages simultaneously. A pressure responsive flow restricting valve maintains a constant pressure differential on the control spools across the open center flow passages of open center valves. A low pressure regeneration circuit includes provisions for preventing excessive pressure and consequent seal blow-out in the return passages of a control valve assembly. Each of these instrumentalities is capable of being disposed in an end plate section of universal configuration for section control valve asssemblies.

7 Claims, 6 Drawing Figures

HYDRAULIC CONTROL INSTRUMENTALITY

BACKGROUND OF THE INVENTION

This invention relates to pressure and flow control means for hydraulic control valves, and relates to such instrumentality for multiple directional control valve assemblies.

Multiple spool control valves generally comprise a plurality of directional control valve sections, each provided with a shiftable, cannelured control spool controlling fluid flow to one or more specific hydraulic motors, sandwiched between inlet and outlet end plate sections having ports connectable with a source of motive fluid and a low pressure reservoir. Open center type assemblies permit continuous flow transversely through the assembly from inlet to outlet when all the spools are in neutral non-operative positions. Upon shifting a control spool to divert the motive fluid to actuate the associate motor, the spool variably shuts off the open center flow.

A serious drawback to such open center assemblies is the variable pressure differential exerted across the shifting spool. As well known in the art, the resulting abrupt change in direction of the flow at this juncture, Bernoulli forces and other factors combine to exert a substantial force tending to shift the spool. With larger gallonage valves operating at sometimes quite high pressure, the forces exerted on the spool make it extremely difficult to control spool movement manually. While this problem is somewhat reduced by utilizing power means other than manual force to move the spool, the same forces caused by these pressure differentials are still present, and control of spool movement remains too unpredictable and non-repeatable to provide precise and effective flow control. Furthermore, the use of power means to shift the spool drastically compounds the complexity, expense, and other undesirable features of flow control valves.

Another problem associated with multiple valve assemblies capable of handling large flow volumes relates to the master relief valve. For economy and convenience, it is highly important that the master relief valve, which must be capable of handling the maximum flow volume of the valve assembly to protect same under all conditions, be of a compact nature capable of being incorporated into the control valve assembly itself. Placement of additional housings onto the valve assembly is not feasible in many instances because of critical space limitations. To function properly, however, the master relief valve is best located as near as possible to the control valves to insure immediate relief of build-up of excessive pressure. Such consideration is also highly important in minimizing extremely high pressure surges of short duration which occur for various reasons and particularly when quickly opening and closing fluid passages by sudden movement of the closing fluid passages by sudden movement of the control valve spools.

A particular type of control valve circuitry that has found wide acceptance in valve assemblies is regenerative circuitry. This is especially necessary in operating a heavily loaded hydraulic motor whose external load is capable of outrunning the fluid flow delivered thereto, resulting in a cavitation condition. Regenerative circuitry alleviates this problem by diverting the fluid flow being exhausted from the overrunning motor back to the inlet side of the motor to supplement inlet flow.

While such circuitry is adequate in many applications, in certain situations pressure surges develop in the regenerating exhaust flow that is being carried through the low pressure passages in the control valve assembly. In such instances the sealing members surrounding these low pressure passages are easily destroyed by the pressure surges. The expense involved in attempting to utilize high pressure sealing members for the low pressure return passages has heretofore been found unacceptable, rendering the valve assemblies non-competitive.

Accordingly, it is the primary object of the present invention to provide an open center type control valve having a pressure control member that automatically maintains a substantially constant pressure differential across the control valve spool at the open center passages to provide constant handle forces and accurate metering of the control spool.

A more particular object in accordance with the preceding object is to provide a pressure responsive member intercepting the open center passages downstream of the spool and operable to variably restrict flow through the open center passages, the member being positioned in response to the pressure differential created by the spool in a manner maintaining a constant pressure differential across the latter.

A corollary to the above objects is to provide such a pressure control member in an assembly of stack valves that is operable to maintain a constant pressure differential across any one of the spools that is shifted.

Another object of the invention is to provide a pressure relief valve capable of relieving fluid flow through more than one exhaust passage to present a compact valve capable of being incorporated within the housings of control valve assemblies.

A further object in accordance with the preceding object is to provide a relief valve of the type described that is pilot operated to provide superior valve opening characteristics.

Another important object of the present invention is to provide an assembly for controlling a hydraulic motor subject to large inertial loads, wherein there is provided low pressure regenerating means for diverting fluid displaced from one side of the motor back to the other side to preclude formation of cavitation conditions, and wherein is provided means for relieving instantaneous surge pressures in the low pressure return circuitry to prevent seal destruction.

A more particular object in accordance with the preceding object is to provide means of the type described that may be easily and conveniently incorporated into directional control valve assemblies.

Another broad object of the present invention is to provide an improved end plate section of universal configuration capable of being utilized as either an inlet or outlet port plate for sectional control valve assemblies and which is provided with a transfer passage means selectively communicating fluid inlet and outlet ducts of the valve assembly, the end plate section being configured to permit utilization of various fluid flow control instrumentalities for controlling flow to the transfer passage means.

These and other more particular objects and advantages of the present invention are specifically set forth in, or will become apparent from the following detailed description of a preferred form of the invention when read in conjunction with the accompanying drawings, wherein.

Figure 1:
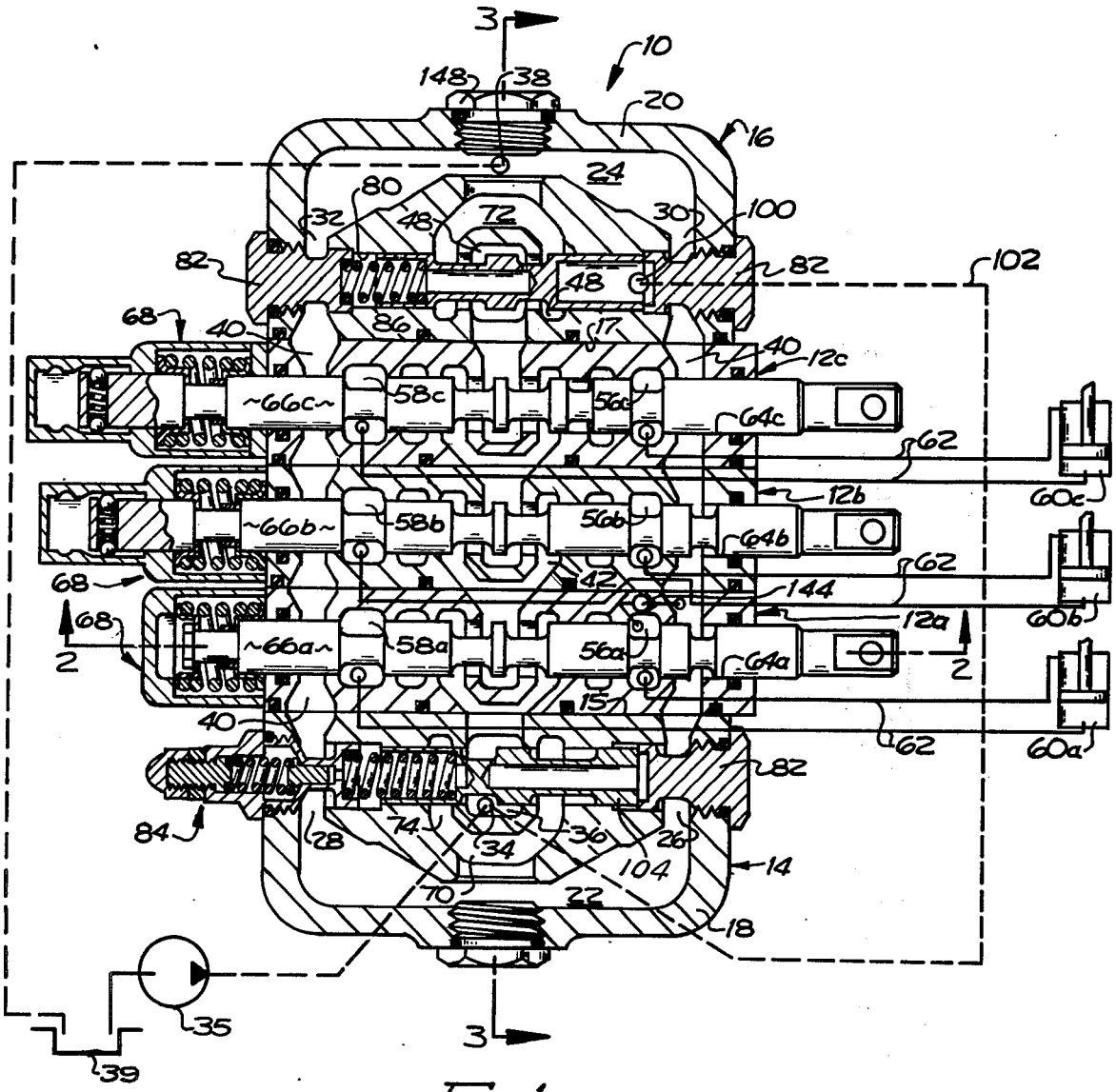
FIG. 1 is a central cross-sectional plan view, with certain elements shown schematically, of a multiple spool stack valve and hydraulic system embodying certain principles of the present invention.
Figure 2:
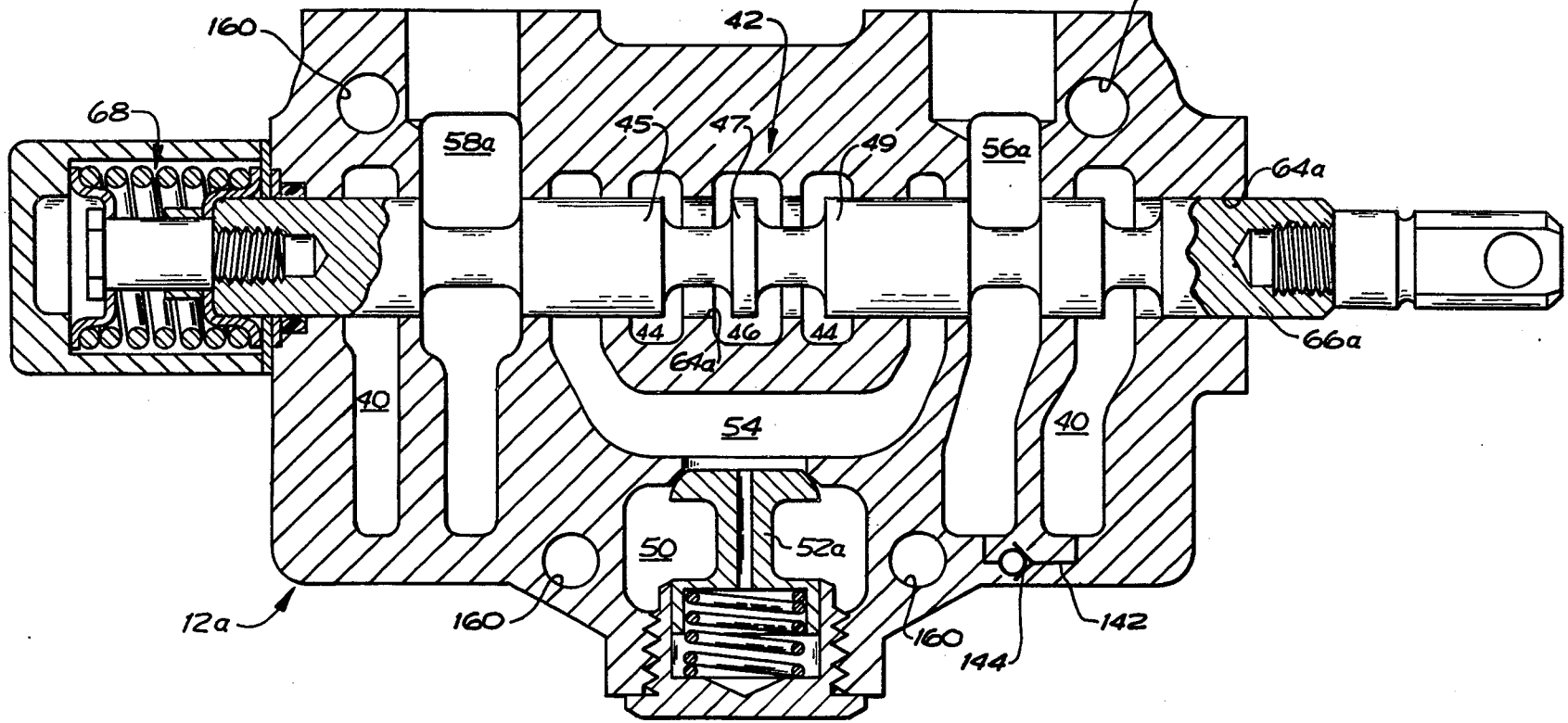
FIG. 2 is an enlarged, longitudinal, plan, cross-sectional view taken along lines 2 — 2 of FIG. 1 of one directional control valve section.
Figure 3:
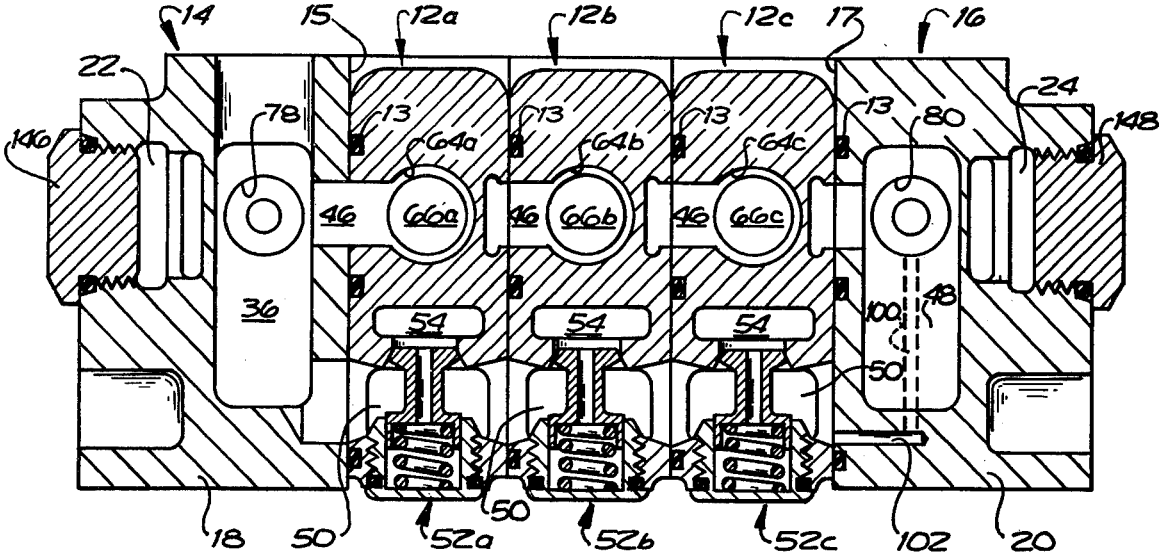
FIG. 3 is an enlarged, transverse cross-sectional plan view taken along lines 3 — 3 of FIG. 1.

Referring now to the drawings for a more detailed description of the drawings and particularly to FIGS. 1 through 3, there is illustrated a multiple spool sectional control valve assembly 10 including a trio of directional control valve sections 12*a*, 12*b*, 12*c* sandwiched between an inlet port plate section 14 and an outlet port plate section 16. Appropriate securing means, not seen in the drawings, bolt the several sections together through openings 160 in FIG. 2, with the faces 15 and 17 abutting the adjacent control valve sections. O-ring seals 13 are utilized between the sections in a conventional manner.

Each of the end plate sections 14 and 16 are of similar construction, comprising bodies 18 and 20 having exhaust passage means including longitudinally extending passages 22, 24 respectively connecting with transverse passages 26, 28, 30 and 32 located at opposite ends of the sections 14 and 16. A fluid inlet port 34 adapted to be connected with a source of pressure motive fluid 35, opens into a centrally disposed inlet passage 36 in the inlet port, and an outlet port 38 adapted to be connected to a low pressure fluid reservoir 39 communicates with the exhaust passage means in outlet end plate 16.

The valve sections 12*a, b, c,* have a pair of transversely extending return ducts 40 that interconnect the leg passages 26 and 28 of the inlet plate with the corresponding outlet plate leg passages 30 and 32. Each valve section is provided with conventional open center passage means 42, comprising a pair of passages 44, straddling center passage 46, that communicate to normally connect inlet passage 36 with a similar central inlet passage 48 in the outlet section 16. A parallel duct 50, as seen in FIGS. 2 and 3, extends from inlet passage 36 through the several valve sections 12*a, b, c,* and communicates across a corresponding lift check valve 52*a, b, c,* to a respective U-shaped supply passage 54 that straddles the open center passages 44 in each valve section. Each valve section has work port ducts 56 and 58 that respectively connect with the opposite sides of double acting hydraulic cylinder motors 60*a, b, c,* via conduits 62. Each valve section is also provided with longitudinal bores 64*a, b, c,* intercepting the open center passage means 42, and the respective U-shaped supply passage 54, work port ducts 56, 58 and return ducts 40. In each bore there is provided a cannelured, shiftable control valve spool 66*a, b, c,* having reduced diameter lands capable of selectively interconnecting the various passages intercepting bores 64*a, b, c,* to control flow to and from the hydraulic motors. Spring centering mechanisms 68 bias each manually operated spool 66*a, b, c,* to the illustrated neutral position clearing open center passage means 42. With the exception of the construction of end plates 14 and 16, the above described control valve assembly and hydraulic system is of a conventional nature well known in the trade and its operation and further detailed description thereof will not be set forth herein.

Each of the inlet and outlet plate bodies is also provided with transfer passage means 70, 72 communicating with exhaust passages 22, 24 and including a pair of transversely extending leg passages 74, 76 that straddle the respective inlet passages 36 and 48. In each body 14 and 16, is a longitudinal bore 78, 80 whose opposite ends are closed from direct communication with return passages 26, 28, 30 and 32 by end plugs 82 and 84.

Figure 4:
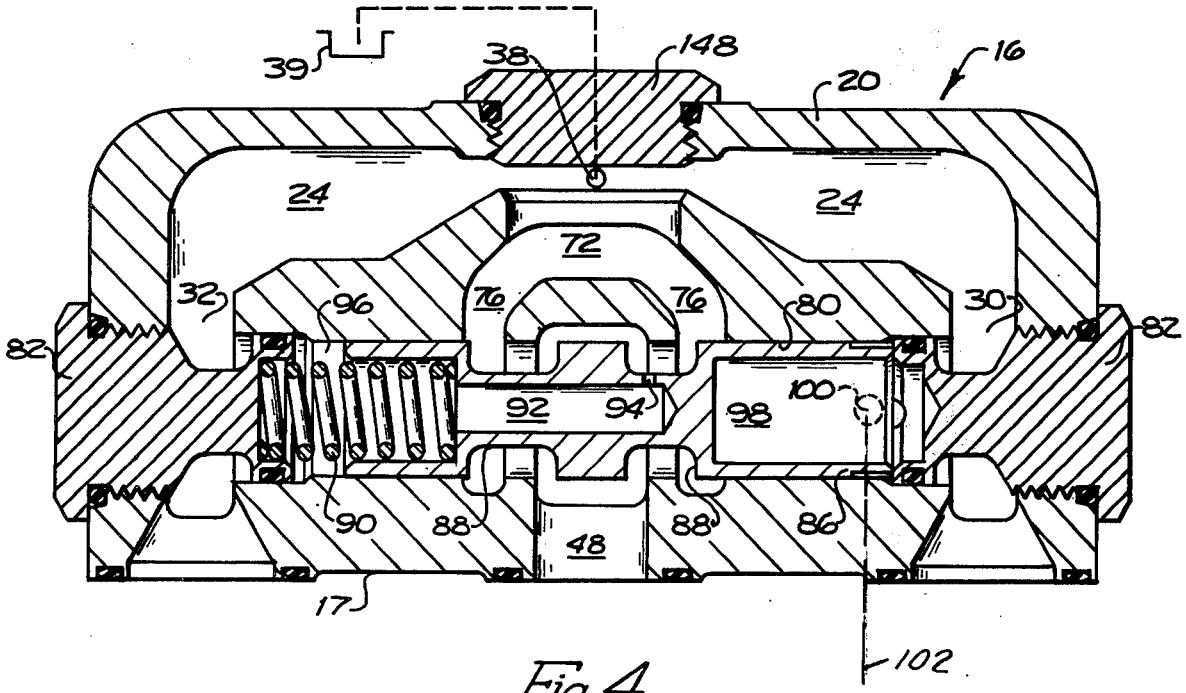
FIG. 4 is an enlarged view of the outlet end plate and open center pressure control valve illustrated in FIG. 1.

Referring now to FIG. 4 in particular, shiftably mounted in bore 80 is flow control instrumentality in the form of a cannelured spool 86 having a pair of reduced diameter grooves 88 that normally interconnect inlet passage 48 with leg passages 76 when spool 86 is shifted rightwardly, as shown, under the urgings of biasing spring 90. A blind bore 92 and cross duct 94 in spool 86 communicate pressure from inlet passage means 48 to the left end of closed servo chamber 96 containing spring 90. At the right end of spool 86 there is presented another closed servo chamber 98 that connects via bores 100, 102 (FIGS. 3 and 4) in end body 20 with the parallel duct 50, thereby communicating the pressure in the inlet plate passage means 36 with chamber 98. The pressure differential between inlet passage means 36 and 48, therefore, is exerted upon spool 86 along with the force of spring 90 to position shift the latter within bore 80.

OPERATION OF PRESSURE CONTROL SPOOL

Upon shifting one of the control valve spools 66*a, b,* or *c,* to actuate its associated motor, the shifted spool conventionally begins restricting fluid flow through the open center passage means 42 by lands 45, 47 and 49 blocking flow of fluid from passages 44 to to passage 46 (FIG. 2). This causes a pressure drop across the shifted control spool 66 which gives rise to various longitudinally acting forces on the shifted spool. Normally, the pressure drop varies markedly in relation to travel of the shifted spool 66, thereby creating varying forces on the spool.

Pressure control spool 86 alleviates these problems by maintaining a constant pressure drop across the open center passage means 42 at the shifted spool 66*a,* regardless of the distance of travel of the latter mentioned spool and regardless of the magnitude of pressure developed in actuating the associated motor 12*a.* Spool 86 operates as a second flow restrictor in the open center passage means downstream of the shifted spool 66*a.* Spool 86 restricts flow to maintain a constant pressure difference between inlet passage means 36 and outlet passage means 38, the magnitude of such pressure difference being proportional to the force exerted by spring 90 which, for example, could be 200 psi. The location of pressure control spool 86 in the outlet section 16 downstream of all the control valve sections allows spool 86 to operate as described regardless of which spool 66*a, b, c,* is operated. In referring to FIG. 4, the control spool 86 remains in its non-flow restricting position, as illustrated, until the pressure drop across the open center passage 42 of control spool 66*a* reaches a said amount. At that point, the pressure sensed in chamber 98 is sufficient to overcome the combined force of spring 90 and pressure force in chamber 96 to cause the pressure control spool 86 to move to the left.

Any leftward movement causes a restricting effect of the fluid flow across spool 86 thereby building up back pressure in inlet passage 48, which effectively reduces the pressure drop across the control spool 66*a*. Spool 86 will further restrict the downstream flow depending upon the load on the motor 60*a*, to the degree necessary to maintain a constant drop across the open center of control spool 66*a*.

Figure 5:
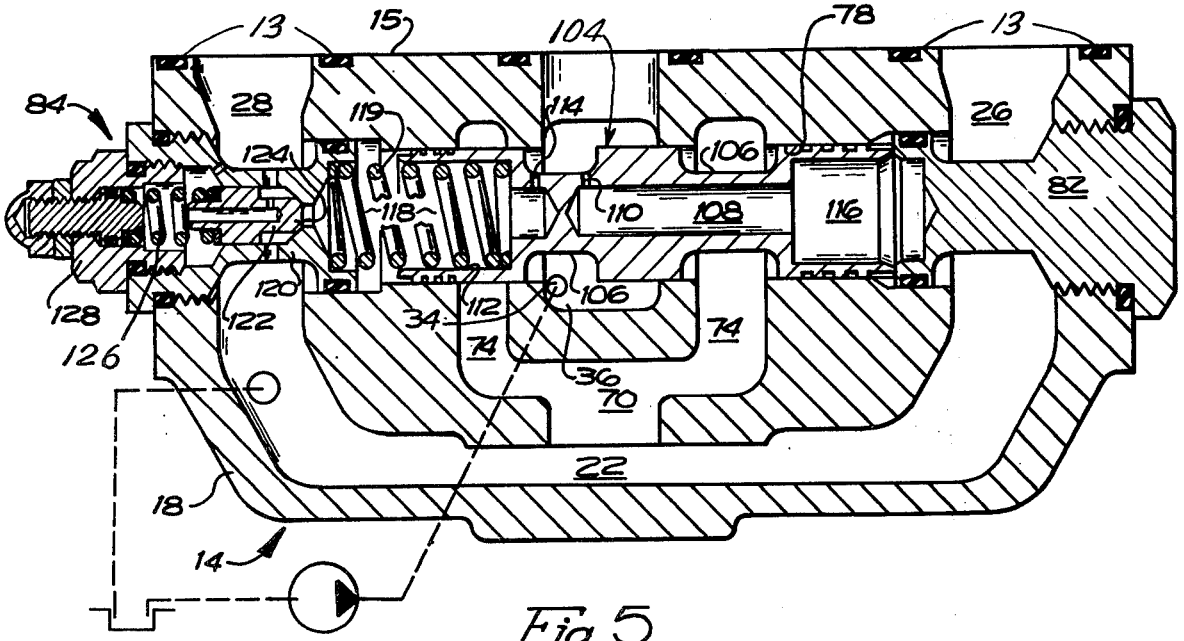
FIG. 5 is an enlarged view of the inlet end plate and master relief valve illustrated in FIG. 1.

Referring now to FIG. 5, shiftably mounted within bore 78 is a cannelured control spool 104 having a pair of grooves 106 for selectively connecting inlet passage means 36 with leg passages 74. Spool 104 has a pair of separate blind bores 108, 112 and associated cross ducts 110, 114, with bores 108 and 112 opening into closed chambers 116, 118 at opposite ends of spool 104, so that the pressure of inlet passage 36 is communicated to both ends of spool 104. Spring 119 normally urges spool 104 rightwardly to the closed, flow blocking position illustrated.

End plug means 84 is in the form of a pilot pressure relief valve and includes a major body 120 internally bored to provide a discharge passage for selectively communicating closed chamber 118 with exhaust leg passage 28. A poppet 122 has a face 124 exposed to the pressure of chamber 118 and biased by spring 126 to its closed position engaging body 120 to block fluid flow from chamber 118 to exhaust leg passage 28. An adjusting nut 128 is threadably received in body 120 and is capable of selectively adjusting the tension of spring 126 and, thus, the pressure required in chamber 118 to move poppet 122 to an open position.

OPERATION OF MASTER RELIEF VALVE

Spool 104 of FIG. 5 acts as a master pressure relief valve for the control valve assembly 10, limiting pressure which may build at inlet port 34 and inlet passage 36 to a maximum preselected level that is determined by the force exerted by pilot spring 126. The inlet pressure presented in chambers 116 and 118 exerts zero net force on spool 104 so that the relatively weak spring 119 may act effectively in holding spool 104 in its closed position. When inlet pressure reaches a predetermined level, poppet 124 will shift to an open position permitting escape of fluid from chamber 118 at a rate faster than it is flowing into the chamber through cross duct 114. Chamber 118 pressure drops below the inlet pressure in chamber 116 so that the tension of spring 119 is overcome, and spool 104 shifts leftwardly. Leftward movement of spool 104 connects inlet passage means 36 simultaneously with both of leg passages 74 to relieve fluid and pressure in passage 36 in two directions to longitudinal exhaust passage 22, leg passages 28 and ultimately through the return ducts to the assembly outlet port as seen in FIG. 1. By connecting the inlet passage with the pair of outlet passages 74, the relief valve is capable of relieving a large flow volume in relation to the diameter of spool 104. Particularly advantageous in high gallonage fluid power systems, the master relief valve of the present invention provides accurate control of the maximum pressure unaffected by variations in inlet flow volumes. This is attributable to the two substantially large and equal flow paths through legs 74 that are created with a minimum amount of movement of spool 104, while still maintaining the advantageous operational characteristics of a smaller diameter spool valve. Additionally, the configuration of the relief valve means permits utilization of pilot operated type relief valve having superior pressure opening or "cracking" characteristics. At the same time, the relief valve structure is capable of being incorporated into the improved universal inlet section 15. The relatively small overall size of the relief valve in relation to its volume capabilities allows it to be placed within the control valve assembly 10 without increasing the size of the latter or creating obtruding structure that would interfere with external structure adjacent the assembly, thereby increasing the adaptability of mounting the assembly in small spaces.

Figure 6:
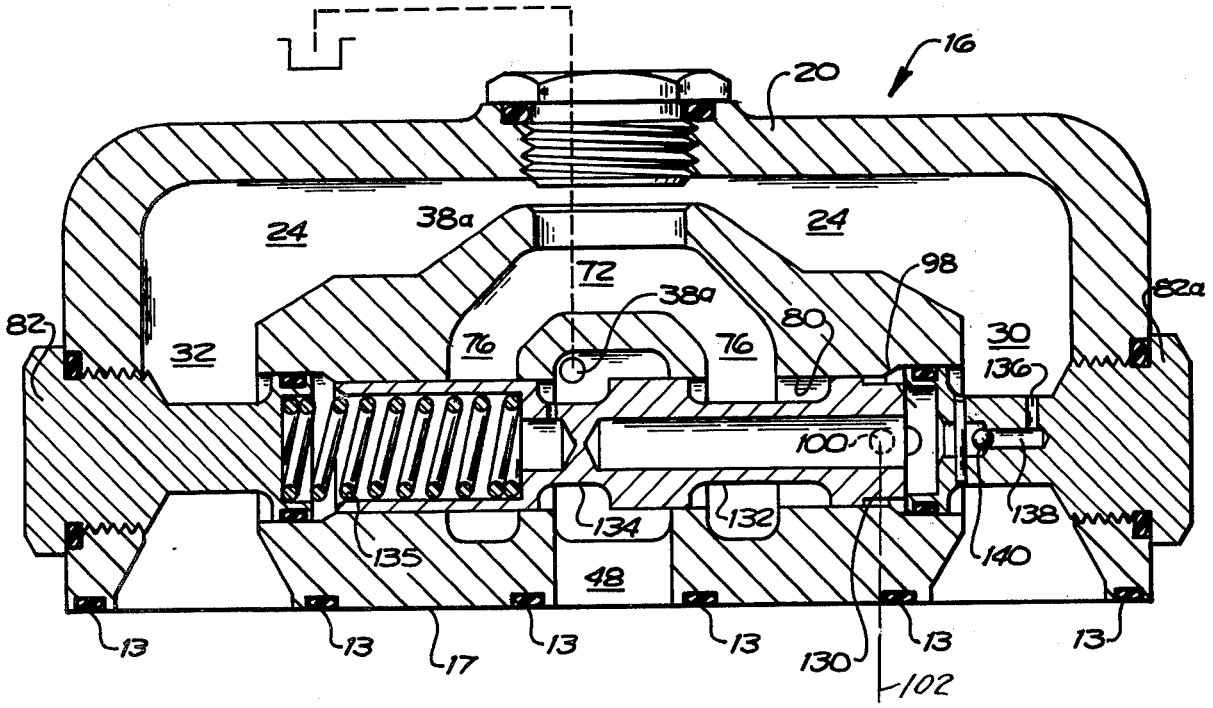
FIG. 6 is an enlarged view similar to FIG. 4, of the outlet end plate but showing low pressure regenerative control means.

FIG. 6 illustrates another control valve instrumentality that may be disposed in the bore 80 of outlet section 16 in place of the spool 86 of FIGS. 1 and 4. Body 20 is identical in construction as that shown in FIG. 4, with the exception that the outlet port 38*a* communicates with inlet passage means 48 instead of longitudinal exhaust passage 24. It will be apparent, therefore, that body 20 in FIG. 6 is identical in structure to inlet body 18.

The instrumentality of FIG. 6 includes a cannelured spool 130 having at least one groove 132 and, in the preferred embodiment, a second groove 134. A relatively weak spring 135 engages the left end of spool 130 maintaining it in closed position as shown, though, in contrast to the FIG. 4 instrumentality, which maintains spool 86 normally in the open position. Spool 130 is normally held in an open position interconnecting passage 48 with leg passages 76 by the pressure communicated from the inlet pressure passage 36 via ducts 100 and 102 to the closed chamber 98 at the right hand end of spool 130.

A modified end plug 82*a* closes the rightward end of bore 80. Plug 82*a* includes internal passages 136, 138 connecting chamber 98 with exhaust leg passage 30 and, therefore, the right hand return ducts 40 extending transversely through the valve sections 12*a, b, c*. A conventional ball check valve 140 is interposed in passage 138 and acts to permit only one-way flow from exhaust leg passage 30 to closed chamber 98 while blocking reverse flow.

Spool 130 acts as a regenerative flow control and in this connection, the regenerative flow circuitry includes a passage 142 and one-way check valve 144 in control valve section 12*a*, as schematically depicted in FIG. 1 and as shown in cross-section in FIG. 2. Passage 142 extends between return duct 40 and work port duct 56*a*. Check valve 144 permits free fluid flow through passage 142 from the exhaust passage to the work port duct whenever pressure in the former exceeds pressure in the latter.

The regenerative circuitry, therefore, presents first passages 100, 102 (FIG. 3 and 6) connecting the inlet passage 36 with chamber 98 to operate spool 130; a second passage 142 (FIGS. 1 and 2) that connects the return duct 40 with the work port duct 56*a*, and third passages 136, 138 (FIG. 6) that connect the return duct, via leg 30, with the first passages 100, 102. These second and third described passages both connect with the return duct upstream of the exhaust flow crossing spool 130 to outlet port 38*a*.

OPERATION OF LOW PRESSURE REGENERATION CONTROL

In normal operation, inlet passage pressure is substantially greater than that in the return ducts 40, and this higher pressure holds spool 130 leftwardly permitting returning flow to be exhausted from ducts 40 through transfer passage 72 and leg passages 76 to outlet port 38*a*.

When spool 64*a* (FIG. 1) is shifted leftwardly to pressurize work port duct 56*a* and cause retraction of the piston of cylinder 60*a*, fluid displaced from the head end of this cylinder returns through work port duct 58*a* to the adjacent exhaust passage 40 to be ultimately exhausted through outlet port 38*a*. In many instances the piston of cylinder 60*a* may be externally loaded so as to be driven downwardly faster than inlet fluid can be supplied through duct 56*a* to the upper end of the cylinder, creating cavitation therein.

In such instance the inlet pressure in the control valve assembly drops to a very low level. The spring 135, in FIG. 6, is thereupon effective to shift spool 130 rightwardly to block any exhaust of fluid flow to outlet port 38*a*. Fluid being returned from the lower end of cylinder 60*a* causes pressure build-up in the now blocked exhaust passage means to a level higher than that in the inlet passages of the assembly. Both check valves 140 of FIG. 6, and 144 of FIGS. 1 and 2 now open to allow the exhausting fluid to be regenerated back to work port duct 56*a* and supplement the inlet fluid flow to the upper end of cylinder 60*a* and prevent cavitation therein. Once the inlet pressure again rises to a safe level, regenerative spool 130 opens to allow fluid exhaust through outlet port 38*a*.

The incorporation of the third passages 136, 138 has been found to be highly effective in relieving surge flow in return ducts 40 and the accompanying pressure peaks that otherwise result from the surge flow. Seal blow-out and other deleterious affects in the low pressure return ducts are thus eliminated. As a consequence, low pressure, economical sealing members can be used adjacent the low pressure return ducts without fear. The regenerative circuitry presented by this invention, therefore, provides a low pressure regenerative system which is highly effective in preventing cavitation. While the regenerative circuitry has been described with respect to a single motor 60*a* and associated check valve 144, it will be apparent that any one or more of the motors may similarly be provided with the regenerative feature simply by including additional check valves 144 where desired.

The universal structure of the end sections 14 and 16 permits a variety of circuitry configurations with a minimum of component variation. The instrumentalities of FIGS. 4, 5, 6, are different only in the spool instrumentality contained within the longitudinal bore of the end sections, and in the type of end plugs 82, 82*a*, 84*a* which may be quickly and easily installed. Thus, several circuitry variations can be accomplished within a single end section configuration simply by selection of specific end plugs and spools. The variation in port location, as will be apparent to those skilled in the art, can be attained within a single end section casting by providing machined bosses at the desired locations and plugging those not being utilized, like is done by plugs 146 and 148 of FIG. 1. The universality of the end section structure substantially reduces the number of components, tooling costs, set-up costs and other problems and expenses associated with mass production, manufacture and sale of control valves of varied capabilities and functions.

Having thus described the invention, what is claimed as new and desired to be secured as Letters Patent, is:

1. In a multiple spool hydraulic control valve having a plurality of directional control valve sections intersecured as a single assembly and defining inlet and outlet ducts extending transversely through the assembly; an end section for said assembly, comprising:

a body having a longitudinal face securable in sealed relationship to one end of said assembly;

exhaust passage means in the body including a longitudinally extending exhaust passage adjacent a side of the body remote from said face, and two transverse exhaust passages each extending from said longitudinal exhaust passage to said face to communicate with said outlet ducts of the assembly;

centrally disposed inlet passage means in the body extending transversely from said face and communicating with said inlet duct of the assembly;

transfer passage means in the body communicating with said longitudinal exhaust passage and including a pair of transverse leg passages spaced from and straddling said inlet passage means; said body having a longitudinal bore therethrough intercepting said transverse exhaust passages, inlet passage means and said leg passages;

means cooperating with said body for closing said opposite ends of said longitudinal bore and separating the bore from said transverse exhaust passages;

an exterior connecting port in the body communicating with at least one of said exhaust and inlet passage means for delivery of fluid to or discharging fluid from said assembly;

flow control instrumentality shiftably mounted in said longitudinal bore for selectively interconnecting said inlet passage means with said leg passages to control said delivery of fluid to or discharge of fluid from said assembly, said instrumentality being pressure actuated to shift within said longitudinal bore, there being means in the body for admitting actuating pressure to the bore between the instrumentality and said closing means.

2. An end plate section as set forth in claim 1, there being means in said closing means for selectively connecting one of said transverse exhaust passages to said one end of the longitudinal bore.

3. An end plate section as set forth in claim 1, said port communicating with said inlet passage means, said instrumentality comprising a relief valve means shiftable to interconnect said inlet passage means with said leg passages whenever pressure in said inlet passage means reaches a predetermined level.

4. An end plate section as set forth in claim 1, said port communicating with said exhaust passage means, said instrumentality comprising a control spool for variably restricting fluid flow from said inlet passage means to said transverse legs.

5. An end plate section as set forth in claim 1, said port communicating with said inlet passage for discharging fluid to drain; said instrumentality being shiftable between positions variably restricting the fluid flow from the exhaust passage into the inlet passage, whereby the discharge flow is cut-off and regenerated.

6. An end plate section as set forth in claim 1, said port communicating with said inlet passage and a second port communicating with said exhaust passage.

7. An end plate section as set forth in claim 1, the portions of said bore adjacent the ends of said flow control instrumentality forming opposing chambers inwardly positioned from the transverse exhaust passages for shifting said instrumentality and said means cooperating with said body for closing the ends of the bore also separates the opposing chambers from the transverse exhaust passages.

* * * * *